US006435688B1

(12) United States Patent
Pittman

(10) Patent No.: US 6,435,688 B1
(45) Date of Patent: Aug. 20, 2002

(54) TOY FOR CREATING VISUAL AND AUDIAL PATTERNS

(75) Inventor: Douglas E. Pittman, San Antonio, TX (US)

(73) Assignee: Gold Penny International Corporation, San Antonio, TX (US)

( * ) Notice: Subject to any disclaimer, the term of this patent is extended or adjusted under 35 U.S.C. 154(b) by 0 days.

(21) Appl. No.: 09/736,775

(22) Filed: Dec. 14, 2000

(51) Int. Cl.[7] ..... F21V 33/00; F21S 4/00

(52) U.S. Cl. ..... 362/34; 362/96; 362/806; 362/253; 362/189; 446/219; 446/220

(58) Field of Search ..... 362/96, 189, 363, 362/806, 34, 84; 446/220, 224, 219; 137/223

(56) References Cited

U.S. PATENT DOCUMENTS 3,800,132 A * 3/1974 Postal ..... 362/34
5,102,364 A * 4/1992 Kubiatowicz ..... 446/220
5,119,281 A * 6/1992 Akman ..... 362/253
5,143,439 A 9/1992 Lewis et al.
5,282,768 A * 2/1994 Akman ..... 446/220
5,557,869 A * 9/1996 Douglas ..... 40/542
5,947,581 A 9/1999 Schrimmer et al.
6,106,135 A * 8/2000 Zingale et al. ..... 362/186

* cited by examiner

*Primary Examiner*—Thomas M. Sember
(74) *Attorney, Agent, or Firm*—Jackson Walker L.L.P.

(57) ABSTRACT

A toy for creating visual and audial patterns that is activated by the agitation of chemiluminescent members or colored sticks within an inflated bladder. The light is generated by the chemiluminescent sticks or the color of the sticks is visible outside the bladder. The sticks are elongated cylinders which roll along the inner walls of the inflated bladder creating unique audial perceptions and visual designs. A sealing closure is used to prevent deflation of the inflated bladder containing the members.

12 Claims, 1 Drawing Sheet

TOY FOR CREATING VISUAL AND AUDIAL PATTERNS

BACKGROUND OF THE INVENTION

The present invention relates generally to a game toy for recreation; amusement; education; and, more particularly, to a game toy that creates unique visual and audial patterns. Luminescent members inside a bladder may be activated after insertion within an inflated bladder causing the chemicals within the members to emit observable light detectable to an observer of the bladder. The members are cylindrically shaped to roll along the inner arcuate walls of the bladder to create a unique sound.

Air filled spheres and bladders are well known in the art. For instance, U.S. Pat. No. 303,885 discloses a flying target consisting substantially of a flat ring having a central opening in which an inflatable balloon or "bulb" is held. The bulb is manually inflated to give body to the target. Two semicircular wires or bands are pivotally mounted to ring and are swung to hold it in position and prevent over-inflation. The bulb is inflated through a tube mounted to the ring that is pinched, preferably by the user's teeth, to seal the bulb. A major drawback to the prior art device is that the bulb is retained within the ring by both the inflation tube and the pair of semicircular wires, which adds to the complexity and weight of the toy. While the prior art device may be suitable for outdoor use, its weight and complexity make it unsuitable for indoor use especially by young children.

A more pertinent prior art reference is U.S. Pat. No. 5,947,581, which discloses a self-contained light member within a balloon. This reference teaches the insertion of a light button within the gas region of a balloon which is free to move about in the balloon. Such buttons are disclosed in U.S. Pat. No. 5,143,439. The button has a mechanical on/off switch. Thus, a significant disadvantage of the light button is that it must be activated prior to inflation of the balloon. Further, the buttons are generally disk or wafer shaped. They may bounce or rebound about within the balloon, but do not roll along the arcuate inner walls of the balloon creating a distinctive swirling sound.

An alternative embodiment of the invention utilizes elongated cylindrical sticks which are colored to cooperate with the balloon color. Such colored sticks may not be chemiluminescent members, but simply colorful plastic or rubber tubes (hollow or solid).

It is desirable to provide a toy for use by children that is attractive, interesting, and kinetic which holds the attention through both the visual and audial senses.

SUMMARY OF THE INVENTION

The present invention provides a toy which may be luminescent with a unique sound capacity for recreation, amusement and education. The present invention provides an inflatable bladder or balloon having an inlet port or inflation mouth designed to accommodate one or more chemiluminescent members or colored sticks. The chemiluminescent members or colored sticks are sized and shaped so as to be introduceable to the bladder via the inlet port. The chemiluminescent members may be activated before, during, or after insertion. After insertion of the chemiluminescent members or colored sticks into the bladder, the bladder is inflated and a closure is provided to ensure maintenance of an inflated state for the bladder. As a result of the inflation, there exists additional space in which the chemiluminescent members or colored sticks may move about within the bladder. The additional space created by the inflation of the bladder, coupled with an agitation of the bladder containing the chemiluminescent members or colored sticks, results in the chemiluminescent members emitting light and the colored sticks being visible as the members move about inside inflated bladder. More specifically, the sticks are generally elongated and cylindrically shaped tubes and are adapted to roll lengthwise along the inside walls of the balloon. The toy makes a very distinctive sound when the sticks roll along inside the walls of the bladder. In some situations, the user may wish to use simple elongated, cylindrical colored sticks or tubes to replace, or in addition to, the chemiluminescent sticks. This approach is effective when the toys are used in lighted environments, rather than operated in a dark of unlighted environment. The toy creates unusual visual designs and audial perceptions notable outside the inflated bladder.

The present invention, thus, provides an amusement device. It also provides a child's game that is inexpensive. The present invention also provides a toy that is luminescent (which may be activated after the balloon is inflated) and may be played with in the dark. The device indirectly develops abilities in mathematics and pattern recognition. The present invention provides an inflatable bladder toy which may be easily constructed from components in kit form.

DETAILED DESCRIPTION OF THE PREFERRED EMBODIMENT

Figure 1:
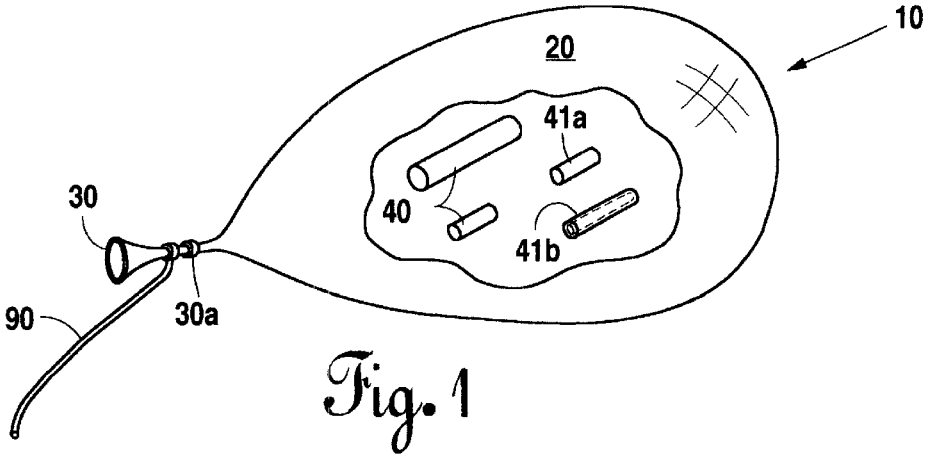
FIG. 1 illustrates a cutaway perspective view of the present invention with the bladder inflated and a multiplicity of chemiluminescent members and colored sticks inside the bladder.

For the purposes promoting and understanding of the principles of the invention, reference will now be made to the embodiment illustrated in the drawings and specific language will be used to describe the same. It will nevertheless be understood that no limitations of scope of the invention is hereby intended, such alterations and further modifications in the illustrated device, and such further applications of the principles of the inventions as illustrated therein being contemplated as would normally occur to one skilled in the art to which the invention relates.

Referring now in more detail to the drawings, in which like numerals indicate like parts throughout the several views, FIGS. 1–5*a* show an assembly, kit, and method of assembly according to a preferred embodiment of the present invention.

Figure 4:
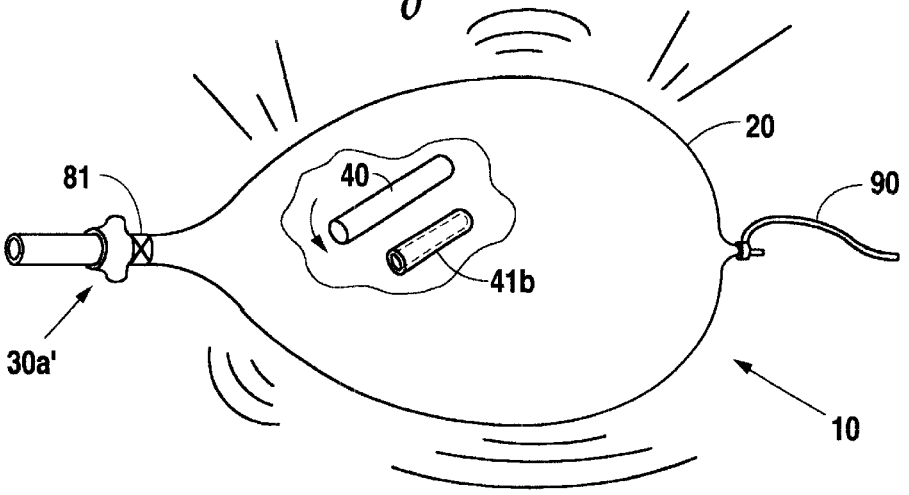
FIG. 4 shows a cutaway perspective of the inflated bladder containing a chemiluminescent member as agitated, activated, and rolling lengthwise along the inner, arcuate walls of the bladder.

FIG. 1 shows the preferred luminescent toy assembly (10) includes an inflatable bladder (20), an inlet port or mouth (30) on a terminal end of the inflatable bladder (20), a closure for sealing (30*a*) the inflated bladder also located at the terminal end of the inflatable bladder (20) thereby preventing deflation of the inflatable bladder (20). The closure (30*a*) is functionally secured at the inlet port (30). The sealing closure may be a simple pinch ring which fits over the bladder and, when crimped, seals the inlet port (30). FIG. 4 shows an alternative closure (30*a*') which has a one-way check valve (80) within the closure. The closure (30*a*') is a tube which allows the user to blow into the bladder but does not allow air to escape. Further, the closure prevents the light stick (40) from accidentally going into the user's mouth.

FIG. 1 shows that a combination of chemiluminescent members (40) and colored sticks (41*a* and 41*b*) may be combined in a balloon (20). The figure shows one solid colored stick (41*a*) and one hollow stick (41*b*). The hollow sticks or tubes create a varying swirl sound when rolling within the balloon.

Figure 2:
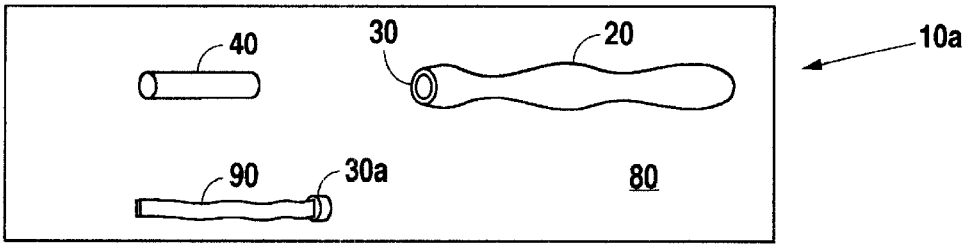
FIG. 2 illustrates a chemiluminescent member external to the deflated bladder.

FIG. 2 shows the separate parts of the present invention. One or more chemiluminescent members (40) or colored sticks or tubes are suitably sized and cylindrically shaped to be insertable through the inlet port (30) of the inflatable bladder (20). As previously stated, in some situations the members (40) may be elongated, cylindrically shaped colored sticks. FIG. 2 shows the bladder (20) deflated. These members (40) are contained within the bladder (20) and may be activated by agitation such that the chemical constituents within the chemiluminescent members (40) are mixed and a light beam becomes visible. Alternatively, the members may be initially frozen and activated upon thawing. Again, the member is thereby activated after insertion into the balloon. One style of chemiluminescent light is known as CYALUME,® a product of American Cyanomid Corporation. One distributor of such light sticks (40) is Omniglow Corporation, Novato, Calif. These sticks are described in U.S. Pat. Nos. 4,076,645; 4,313,843; 4,678,608; 4,717,511; and 5,122,306.

The inflatable bladder (20) is a one piece construct having a first terminus at the inlet port (30). The inflatable bladder (20) may be colored, transparent, or semitransparent such that the light emitted by the activated chemiluminescent members (40), or reflected by the colored sticks (41*a* or 41*b*), is visible outside the inflatable bladder (20) membrane. The inflatable bladder (20) also acts as a container within which the chemiluminescent members (40) are confined. The bladder (20) acts so as to restrict the movement of the chemiluminescent members (40) or colored sticks (41*a* or 41*b*) within the boundaries of the bladder (20). Further, due to its physical properties, the bladder (20) may cause the chemiluminescent members (40) or sticks to rotate against the arcuate internal walls of the inflatable bladder (20) in a random fashion so as to create a chaotic, attractive, and aesthetically pleasing arrangements and visual designs and audial perceptions to an observer (see FIG. 4). Members (40) and sticks (41*a* or 41*b*), with generally elongated cylindrical shapes, cooperate with the inflated bladder walls to create a unique sound as the sticks roll along the inner arcuate wall surface of the balloon yielding a swirling sound audible outside the balloon. Hollow sticks 41*b* create a uniquely distinct sound as compared to the solid sticks and the chemiluminescent members.

All of the FIGS. 1–4 illustrate the elongated, cylindrical shape of the sticks (40). The outer surface of the stick (not the ends) roll (as indicated by the rotation arrow in FIG. 4) along the inner walls of the balloon like logs on an arcuate surface to make a swirling sound. The sticks may also be bounced or rebound from the walls; this yields a popping or snapping sound.

Figure 3:
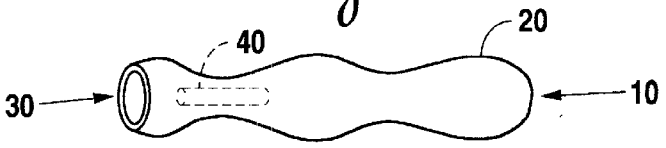
FIG. 3 shows a view of the deflated bladder containing a chemiluminescent member.

The inlet port or mouth (30) of the inflatable bladder (20) is positioned at a terminus of the inflatable bladder (20) such that the inflatable bladder (20) may be sufficiently inflated and further such that the chemiluminescent members (40) of suitable size and shape may be inserted into the inflatable bladder (20) (FIG. 3). The inlet port (30) provides an opening which communicates and traverses the external environment in relation to the inflatable bladder (20) to the internal portion of the inflatable bladder (20). The inlet port (30) provides a location for the sealing closure (30*a*) to be affixed to the mouth (30) to prevent deflation of the bladder (20). Again, an alternative closure (30*a*') may be used.

It should be understood that the present invention includes the unique feature that the color of the bladder may cooperate with the colors of the chemiluminescent member or the colored stick (non-chemiluminescent) to create yet other colors of visible light to the observer. For example, a "red" bladder with "yellow" chemiluminescent members or colored sticks will yield a "green" light visual pattern.

The chemiluminescent members (40), as shown in FIG. 1 are integral to the functionality of the present invention in the dark or lowly lighted environments, and may be activated before, during, or after insertion through the inlet port (30) into the inflatable bladder (20). It is preferable that the sticks be activated after the balloon is inflated. This allows for the toy to be activated in the dark or lowly lighted areas.

The chemiluminescent characteristic of the chemiluminescent members (40) is understood to be activated by slight bending or deforming each chemiluminescent member (40) from its original shape such that the chemiluminescently reactive chemicals contained within each chemiluminescent member (40) react to emit light from each chemiluminescent member (40) which then may be observed outside the inflatable bladder (20). Alternatively, there are frozen sticks (40) which may be activated by thawing.

In one embodiment of the present invention, an elastic band (90) may be affixed to the bladder (20) so that the user can "punch" the bladder back and forth as the band flexes upon the punch's impact. The attachment may be made at the end opposite the closure (30*a*') as shown in FIG. 4.

A method for assembly of the luminescence toy of the present invention (10) includes providing an inflatable bladder (20) having an inlet port (30) located at a first terminus positioned such that one or more chemiluminescent members (40) or colored sticks (41*a* or 41*b*) may be inserted through the inlet port (30) into the inflatable bladder (20) (FIGS. 2 and 3). The chemiluminescent members (40) are activated as set out above either before, during or after insertion through the inlet port (30) of the inflatable bladder (20). Either before, during or after activation of the chemiluminescent members (40) as set out above, the inflatable bladder (20) is inflated by an introduction of a gas through the mouth (30) (with or without the one-way closure valve (30*a*') until the inflatable bladder (20) is inflated to the desired extent. Once the inflatable bladder (20) is inflated to the extent desired, and the chemiluminescent members (40) have been inserted and activated or have been activated and inserted, a sealing closure (30*a*) is positioned on the inlet port (30) (if closure (30*a*') is not used) so as to prevent deflation of the inflatable bladder (20) which now contains one or more chemiluminescent members (40) or colored sticks (41*a* or 41*b*). After inflation of the inflatable bladder (20), the inflatable bladder (20) is substantially spherical in shape, depending on the degree of inflation. In practice, it has been found advantageous to fill the inflatable bladder (20) to the point of inflation such that the inflatable bladder (20) is substantially filled but leaves sufficient space and terminus area at the point of the inlet port (30) for the sealing closure(30*a*) to fit over the inlet port (30) thereby more dependably preventing deflation of the inflatable bladder (20).

Further, an elastic band (90) may be affixed to the bladder (20) at any convenient location to enable the user to snap the bladder back and forth. FIG. 1. shows the band (90) affixed at the inlet of the bladder. FIG. 2 shows the band (90) affixed to the closure (30*a*).

In kit form (10*a*)(FIG. 2), the luminescence toy is supplied in a package (80) with an inflatable bladder (20) having an inlet port (30), one or more chemiluminescent members (40) for activation, either before, during or after inflation or colored sticks (41*a* or 41*b*), and a sealing closure(30*a* or 30*a*') for fixation over the inlet port (30) after the inflation of the bladder having within it one or more chemiluminescent members (40). Thus, the kit contains an inflatable bladder (20) having an inlet port (30), one or more chemiluminescent members (40) or colored sticks (41*a* or 41*b*), securing closure (30*a* or 30*a*')of the inlet port (30) so as to prevent deflation of the inflated bladder (20), an elastic band (90), and the packaging (80). The kit may include a variety of chemiluminescent members and hollow or solid colored sticks, or any combination of these.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A toy for creating visual and audial patterns comprising:

an inflatable bladder having an inlet port;

one or more stick members sized and cylindrically shaped to pass through said inlet port when said bladder is in a deflated condition, said one or more stick members visible outside said bladder when said bladder is in an inflated condition, said one or more stick members cylindrical shape cooperating with arcuate inner walls of said bladder when said bladder is inflated such that said members contact and roll lengthwise along said walls; and a sealing closure affixed to said inlet port of said bladder to prevent deflation of said inflated bladder.

2. The toy of claim 1 further comprising an elastic band affixed to said bladder.

3. The toy of claim 1 wherein said closure has a one-way check valve.

4. A toy for creating visual and audial patterns comprising:

an inflatable bladder having an inlet port;

one or more chemiluminescent members sized and cylindrically shaped to pass through said inlet port when said bladder is in a deflated condition, said one or more chemiluminescent members becoming luminous upon activation of said members and visible outside said bladder when said bladder is in an inflated condition, said members cylindrical shape cooperating with arcuate inner walls of said bladder when said bladder is inflated such that said members contact and roll lengthwise along said walls; and a sealing closure affixed to said inlet port of said bladder to prevent deflation of said inflated bladder.

5. The toy of claim 4 further comprising an elastic band affixed to said bladder.

6. The toy of claim wherein said closure has a one-way check valve.

7. A method for assembling a toy for creating visual and audial patterns comprising the steps of:

providing one or more stick members, said members having elongated cylindrical shapes;

providing an inflatable bladder having an inlet port;

providing a sealing closure for affixation to said inlet port;

inserting through said inlet port of said bladder one or more of said stick members;

inflating said bladder containing said one or more stick members;

affixing said sealing closure to said inlet port of said inflated bladder so as to prevent the deflation of said bladder; and agitating said stick members within said bladder such that said stick members are visible outside said bladder, said members cylindrical shape cooperating with arcuate inner walls of said inflated bladder such that said members contact and roll lengthwise along said walls.

8. The method of claim 7 wherein said stick members are chemiluminescent members.

9. The method of claim 8 comprising the further steps of providing and affixing an elastic band to said bladder.

10. The method of claim 8 wherein said closure has a one-way check valve.

11. The method of claim 7 comprising the further steps of providing and affixing an elastic band to said bladder.

12. The method of claim 7 wherein said closure has a one-way check valve.

* * * * *